US006668936B2

(12) United States Patent
Williamson, Jr. et al.

(10) Patent No.: US 6,668,936 B2
(45) Date of Patent: Dec. 30, 2003

(54) HYDRAULIC CONTROL SYSTEM FOR DOWNHOLE TOOLS

(75) Inventors: Jimmie R. Williamson, Jr., Carrollton, TX (US); Virgilio Garcia-Soule, Carrollton, TX (US); Perry C. Shy, Southlake, TX (US); Leo G. Collins, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 83 days.

(21) Appl. No.: 09/931,322

(22) Filed: Aug. 16, 2001

(65) Prior Publication Data

US 2002/0027003 A1 Mar. 7, 2002

(30) Foreign Application Priority Data

Sep. 7, 2000 (WO) ..... PCT/US00/24551

(51) Int. Cl.[7] ..... E21B 34/10

(52) U.S. Cl. ..... 166/375; 166/240; 166/319; 166/320; 166/386

(58) Field of Search ..... 166/250.01, 250.07, 166/375, 386, 320, 319, 321, 240

(56) References Cited

U.S. PATENT DOCUMENTS

| | | | | |
|---|---|---|---|---|
| 2,183,126 A | | 12/1939 | Uhrig | |
| 2,213,802 A | | 9/1940 | Hogel | |
| 2,683,370 A | | 7/1954 | Bagnell | |
| 2,942,462 A | | 6/1960 | Buck | |
| 4,134,454 A | | 1/1979 | Taylor | |
| 4,249,599 A | * | 2/1981 | Krause | 166/72 |
| 4,660,647 A | * | 4/1987 | Richart | 166/386 |
| 5,211,241 A | | 5/1993 | Mashaw, Jr. et al. | |
| 5,832,996 A | * | 11/1998 | Carmody et al. | 166/53 |
| 5,947,205 A | | 9/1999 | Shy | |
| 6,109,357 A | | 8/2000 | Zimmerman | |
| 6,247,536 B1 | | 6/2001 | Leismer et al. | |
| 6,276,458 B1 | | 8/2001 | Malone et al. | |
| 6,298,919 B1 | * | 10/2001 | Browne et al. | 166/373 |
| 2002/0046845 A1 | * | 4/2002 | Rayssiguier et al. | 166/375 |

FOREIGN PATENT DOCUMENTS

| | | |
|---|---|---|
| DE | 259108 A | 8/1988 |
| EP | 0 893 574 A | 1/1999 |
| WO | WO 98/09055 A | 3/1998 |
| WO | WO 98/39547 A | 9/1998 |
| WO | WO 00/04274 A | 1/2000 |
| WO | WO 00/29715 A | 5/2000 |

OTHER PUBLICATIONS

International Preliminary Report for PCT/US00/24551.
International Search Report for PCT Application No.: PCT/US00/24551.
Partial International Search Report Application No.: PCT/US00/24551.

* cited by examiner

*Primary Examiner*—Hoang Dang
(74) *Attorney, Agent, or Firm*—J. Richard Konneker; Marlin R. Smith

(57) ABSTRACT

A hydraulic control system and associated methods provides selective control of operation of multiple well tool assemblies. In a described embodiment, a hydraulic control system includes a control module which has a member that is displaceable to multiple predetermined positions to thereby select from among multiple well tool assemblies for operation thereof. When the member is in a selected position, an actuator of a corresponding one of the well tool assemblies is placed in fluid communication with a flowpath connected to the control module. When the member is in another selected position, the flowpath is placed in fluid communication with an actuator of another one of the well tool assemblies.

21 Claims, 14 Drawing Sheets

HYDRAULIC CONTROL SYSTEM FOR DOWNHOLE TOOLS

CROSS-REFERENCE TO RELATED APPLICATION

The present application claims the benefit under 35 USC §119 of the filing date of international application PCT/US00/24551, filed Sep. 7, 2000, the disclosure of which is incorporated herein by this reference.

BACKGROUND

The present invention relates generally to methods and apparatus utilized in conjunction with subterranean wells and, in an embodiment described herein, more particularly provides a hydraulic control system for downhole tools.

It would be desirable to be able to operate selected ones of multiple hydraulically actuated well tools installed in a well. However, it is uneconomical and practically unfeasible to run separate hydraulic control lines from the surface to each one of numerous well tool assemblies. Instead, the number of control lines extending relatively long distances should be minimized as much as possible.

Therefore, it would be highly advantageous to provide a hydraulic control system which reduces the number of control lines extending relatively long distances between multiple hydraulically actuated well tools and the surface. The hydraulic control system would preferably permit individual ones of the well tools to be selected for actuation as desired. The selection of well tools for actuation thereof should be convenient and reliable.

Furthermore, it would be desirable to provide methods of controlling operation of multiple well tools, and it would be desirable to provide well tools which may be operated utilizing such a hydraulic control system.

SUMMARY

In carrying out the principles of the present invention, in accordance with an embodiment thereof, a hydraulic control system is provided which reduces the number of control lines extending relatively long distances to multiple well tool assemblies. Well tool assemblies and methods of controlling operation of multiple well tool assemblies are also provided.

In one aspect of the present invention, a control module is interconnected between a flowpath extending to a remote location, such as the surface, and flowpaths extending to multiple well tool assemblies. The control module provides fluid communication between the flowpath extending to the remote location and selected ones of the flowpaths extending to the well tool assemblies, so that corresponding selected ones of the well tool assemblies may be operated by pressure in the flowpath extending to the remote location.

In another aspect of the present invention, the control module is operated to select from among the flowpaths extending to the well tool assemblies by pressure in another flowpath connected to the control module. Yet another flowpath may be connected to the control module to provide a pressure differential used to operate the control module.

Various methods may be used to cause the control module to select from among the flowpaths extending to the well tool assemblies. In one disclosed embodiment, a ratchet device or J-slot mechanism is used to control displacement of a member of the control module. In another disclosed embodiment, a member of the control module is displaced against a force exerted by a biasing device, such as a spring or a compressed fluid.

In yet another aspect of the present invention, various well tool assemblies are provided, which may be operated by the disclosed hydraulic control systems. A variable flow area sliding sleeve-type valve is disclosed. The valve is operated by applying a series of pressures to an actuator thereof to incrementally displace a sleeve of the valve. As the sleeve displaces, the available area for fluid flow through the valve is increased or decreased.

Other well tool assemblies provided are a temperature sensor and a pressure sensor. Each of the sensors is operated by pressure in a flowpath thereof displacing a piston to a position in which the flowpath is placed in fluid communication with another flowpath. In the temperature sensor, the position of the piston corresponds to a known volume of a chamber in which a fluid exposed to the temperature is disposed. In the pressure sensor, the position of the piston corresponds to a known pressure differential between the flowpath and another flowpath exposed to the piston.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
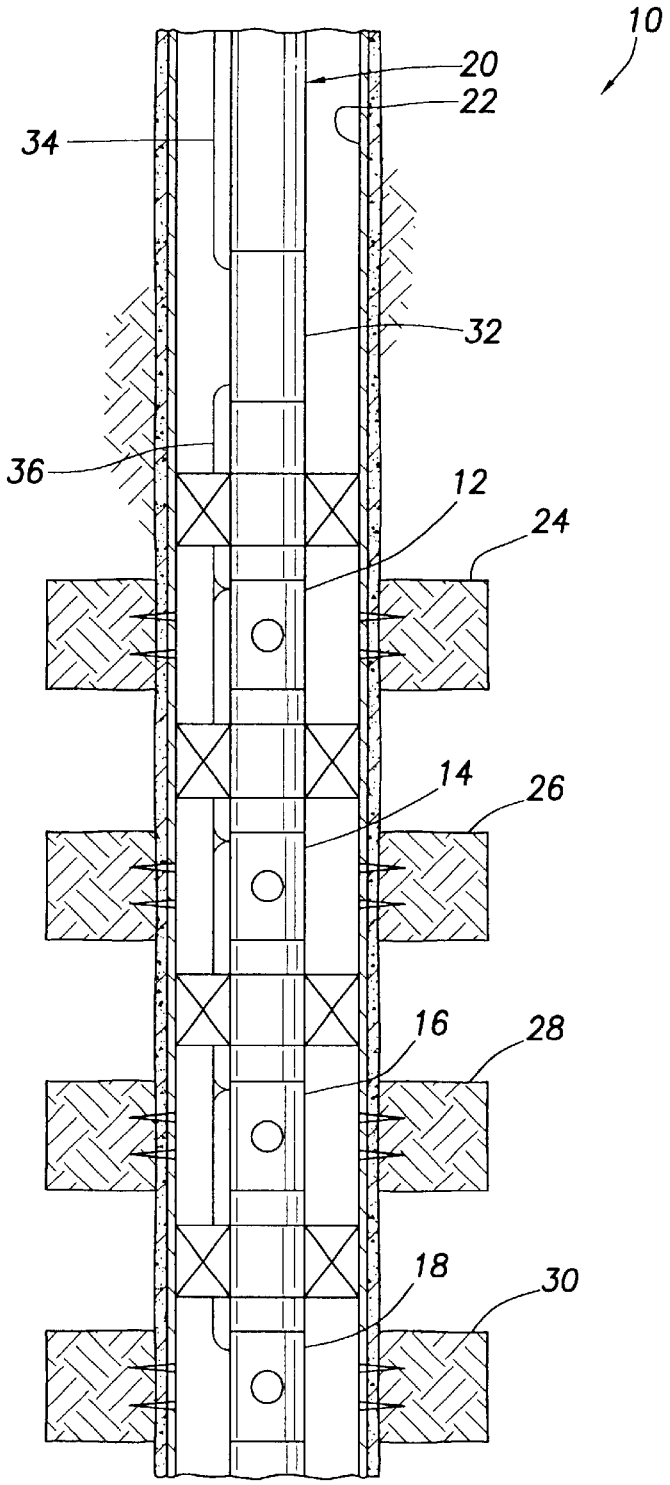
FIG. 1 is a schematic view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, multiple well tool assemblies 12, 14, 16, 18 are interconnected in a tubular string 20 positioned in a wellbore 22. As depicted in FIG. 1, each of the tool assemblies 12, 14, 16, 18 is hydraulically operated and is configured for controlling fluid flow between the wellbore 22 and one of multiple formations or zones 24, 26, 28, 30 intersected by the wellbore. The tool assemblies 12, 14, 16, 18 may be, for example, valves, chokes, or some other type of flow control devices.

Four of the tool assemblies 12, 14, 16, 18 are shown in FIG. 1 for controlling fluid flow for four corresponding zones 24, 26, 28, 30. However, it is to be clearly understood that any number of well tool assemblies may be utilized in a wellbore intersecting any number of zones, and well tool assemblies other than flow control devices may be utilized, without departing from the principles of the present invention. Thus, the method 10 is merely illustrative of one example of an application of the principles of the present invention.

Operation of selected ones of the tool assemblies 12, 14, 16, 18 is controlled by a hydraulic control module 32 interconnected in the tubular string 20. One or more control lines 34, or other type of flowpaths, extend to a remote location, such as the earth's surface, or to a remote location within the wellbore 22, etc. The control module 32 places one or more of the control lines 34 in fluid communication with one or more lines 36, or other types of flowpaths, extending to the tool assemblies 12, 14, 16, 18 when it is desired to operate selected ones of the tool assemblies, for example, to open or close one or more of the tool assemblies.

The control module 32 is interconnected between the lines 34 and the lines 36 and operates in response to pressure in one or more of the lines 34. For example, pressure in one of the lines 34 may be increased to thereby provide fluid communication between another one of the lines 34 and one or more of the lines 36 to thereby operate one or more of the tool assemblies 12, 14, 16, 18. As another example, a pressure differential between two of the lines 34 may be used to cause the control module 32 to provide fluid communication between another one of the lines 34 and one or more of the lines 36. As yet another example, a series of pressure differentials may be applied to the lines 34 to select certain one or more of the lines 36 for fluid communication with certain one or more of the lines 34, etc. Thus, it may be clearly seen that the method 10 permits the tool assemblies 12, 14, 16, 18 to be selected for operation thereof, and subsequently operated, by merely generating appropriate pressures on certain ones of the lines 34.

Figure 2A:
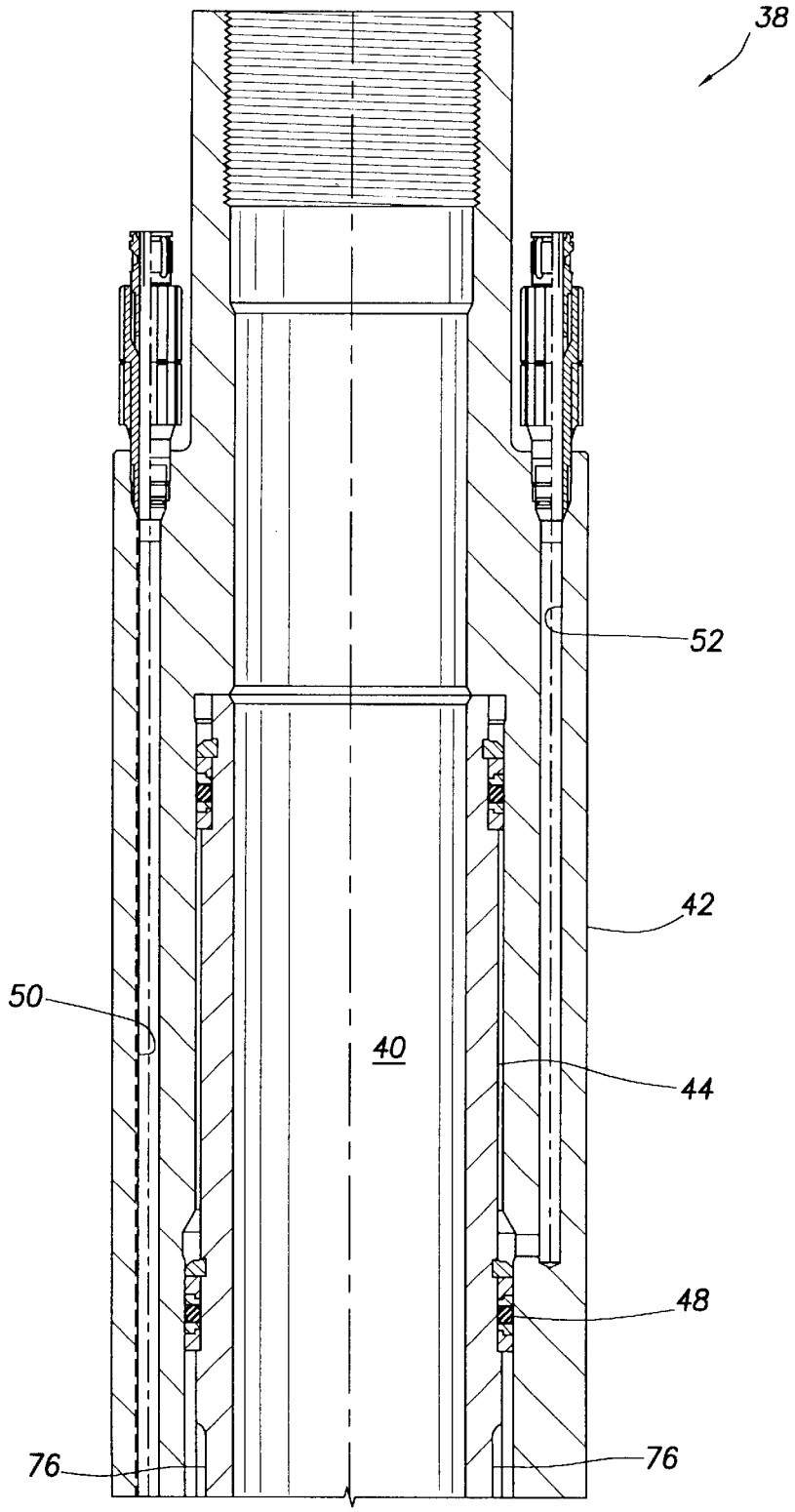
FIGS. 2A–C are cross-sectional views of successive axial portions of a hydraulic control module usable in the method of FIG. 1 and embodying principles of the present invention.
Figure 2B:
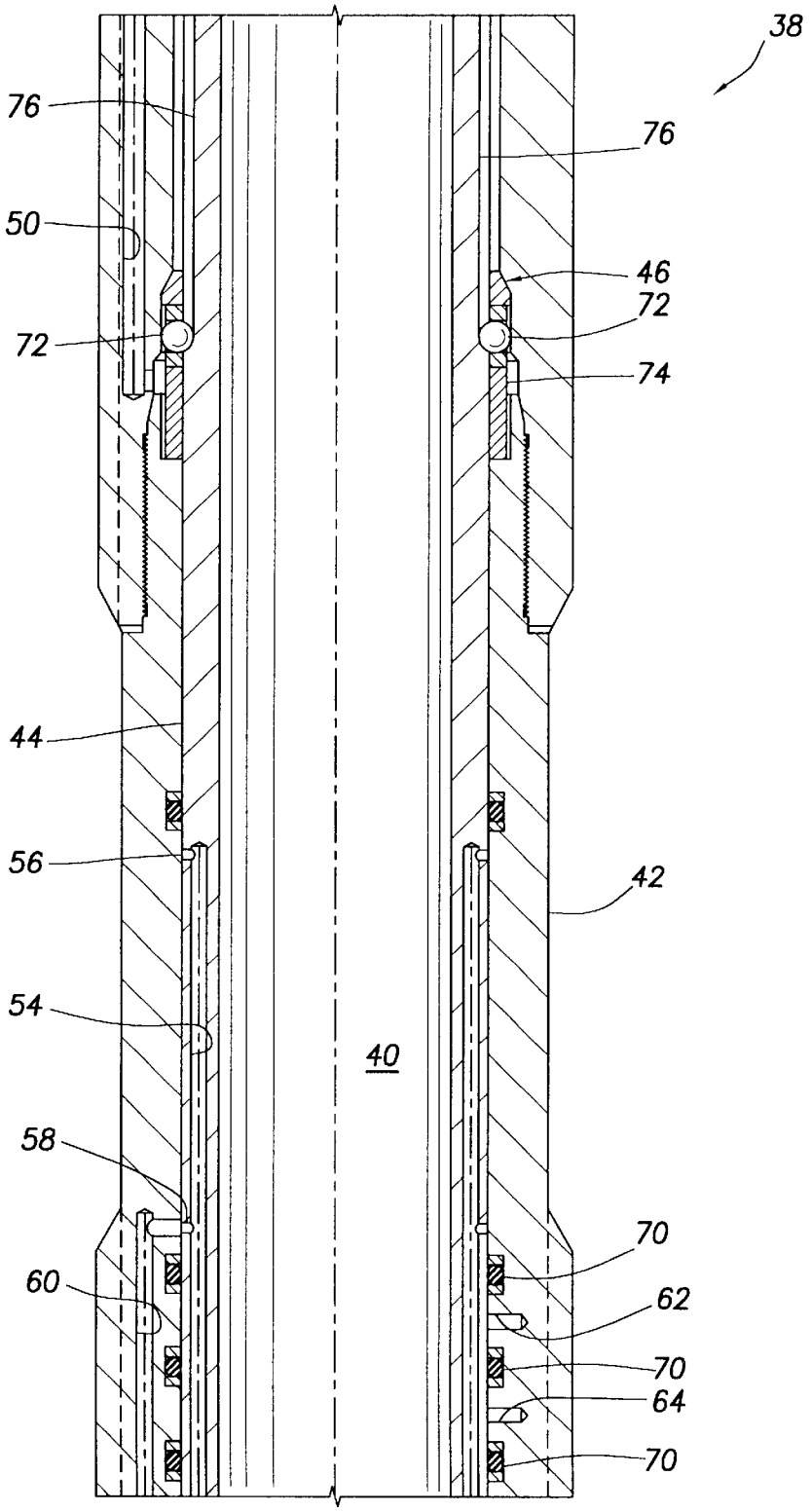
Figure 2C:
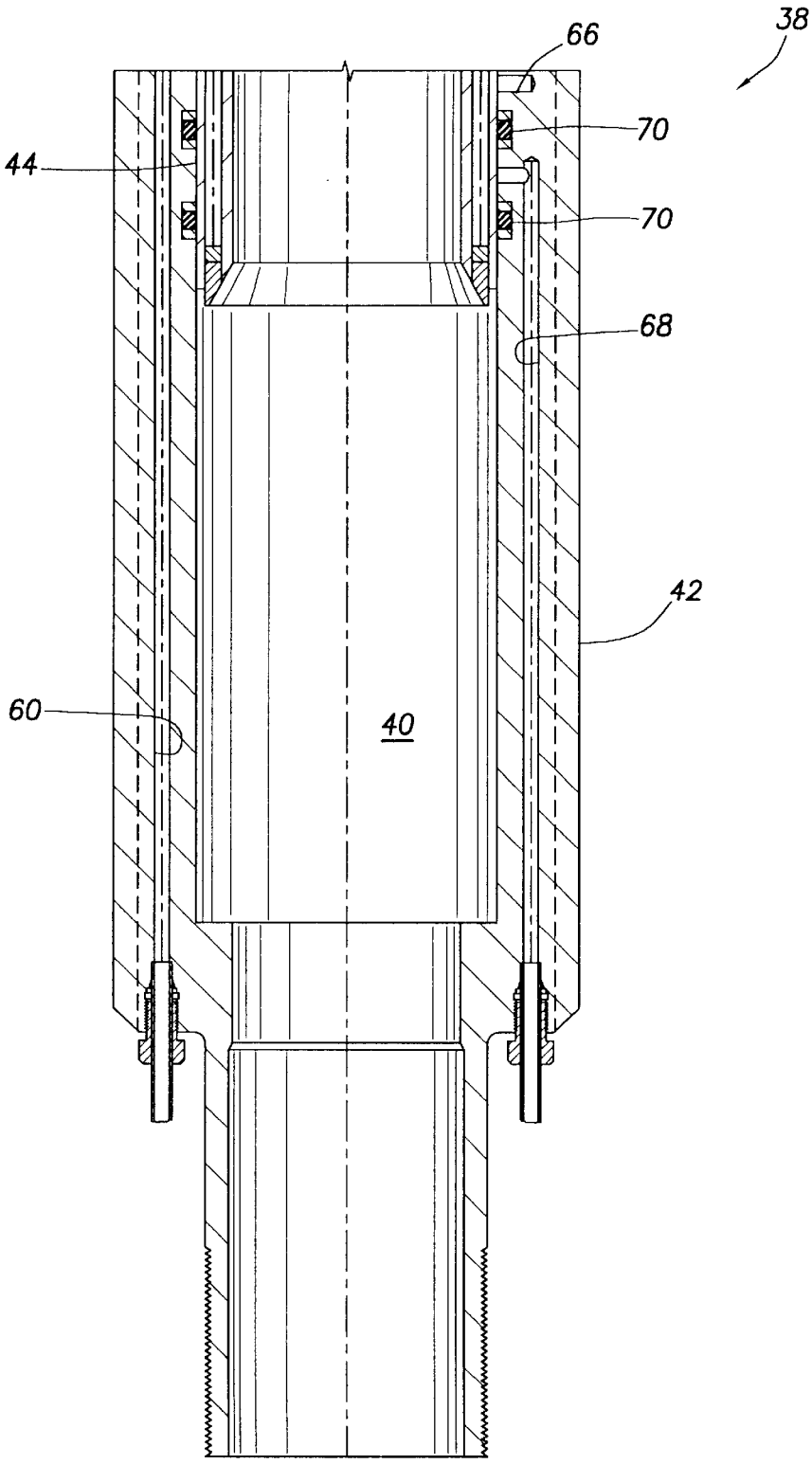

Referring additionally now to FIGS. 2A–C, a hydraulic control module 38 embodying principles of the present invention is representatively illustrated. The control module 38 may be utilized for the control module 32 in the method 10, or the control module 38 may be used in other methods, without departing from the principles of the present invention. The control module 38 is configured for interconnection in a tubular string, such as the tubular string 20 of the method 10, in which case an internal flow passage 40 of the control module would be a part of the internal flow passage of the tubular string, but it is to be clearly understood that the control module may be differently configured, for example, as an integral portion of an actuator or other well tool, without departing from the principles of the present invention.

As depicted in FIGS. 2A–C, the control module 38 includes an outer housing assembly 42, an inner sleeve member 44 and a ratchet device 46. The sleeve 44 is axially reciprocably disposed within the housing 42. Displacement of the sleeve 44 relative to the housing 42 is controlled in part by the ratchet device 46 in a manner described in further detail below.

The sleeve 44 has piston areas formed externally on opposite sides of a seal 48. A flowpath 50 is in fluid communication with the sleeve piston area below the seal 48, and a flowpath 52 is in fluid communication with the sleeve piston area above the seal. It will be readily appreciated by one skilled in the art that, if pressure in the flowpath 50 exceeds pressure in the flowpath 52, the sleeve 44 will be biased upwardly by the pressure differential, and if pressure in the flowpath 52 exceeds pressure in the flowpath 50, the sleeve 44 will be biased downwardly by the pressure differential.

As representatively illustrated in FIGS. 2A–C, the sleeve piston areas above and below the seal 48 are approximately equal, and so the sleeve 44 is displaced with equal force in either direction in response to equal differentials between pressure in the flowpath 50 and pressure in the flowpath 52. However, the manner of displacing the sleeve 44 and its response to differentials between pressure in the flowpath 50 and pressure in the flowpath 52 may be readily changed by, for example, providing unequal piston areas, providing biasing devices, such as springs or compressed fluids, etc., as desired to produce certain forces on, or displacements of, the sleeve. These techniques are well known to those skilled in the art, and will not be described further herein.

Furthermore, it is to be clearly understood that it is not necessary for the sleeve 44 to be displaced by use of a pressure differential between flowpaths, or for the sleeve to be displaced by use of a pressure differential at all. For example, pressure in the flowpath 50 may be used to displace the sleeve 44 against a force exerted by a biasing device. Thus, the sleeve 44 may be displaced in any manner, without departing from the principles of the present invention.

The sleeve 44 has a fluid passage 54 formed internally in a sidewall thereof. The fluid passage 54 communicates with the exterior of the sleeve 44 via two openings 56, 58. The fluid passage 54 remains in fluid communication with another flowpath 60 formed in the housing 42 via the opening 56 as the sleeve 44 displaces relative to the housing. However, the other opening 58 is placed in fluid communication with one of the flowpath 60 or additional flowpaths 62, 64, 66, 68 formed in the housing 42, depending upon the position of the sleeve 44 relative to the housing.

Figure 4:
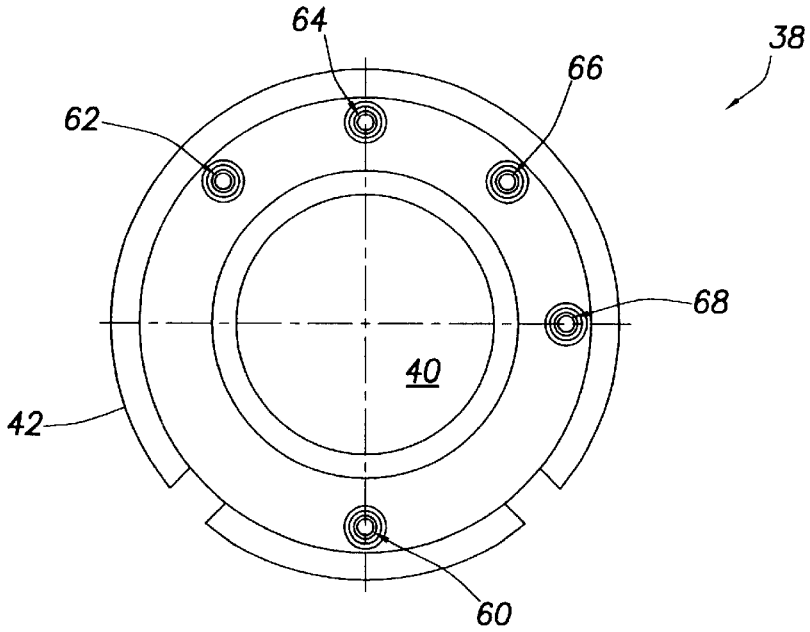
FIG. 4 is an end view of the hydraulic control module.

Of the flowpaths 62, 64, 66, 68, only the flowpath 68 is completely visible in FIG. 2C. Portions of the flowpaths 62, 64, 66 are shown in FIGS. 2B & C, so that it may be seen how the flowpaths 62, 64, 66, 68 are arranged in relation to seals 70 and the opening 58 of the sleeve 44. A lower end view of the control module 38 is shown in FIG. 4, in which it may be seen that the flowpaths 62, 64, 66, 68 are actually circumferentially distributed in the housing 42.

As depicted in FIGS. 2A–C, the fluid passage 54 is in fluid communication with only the flowpath 60 via the openings 56, 58. If, however, the sleeve 44 is displaced downwardly somewhat, so that the opening 58 is between the two seals 70 straddling the flowpath 62, the fluid passage 54 will be placed in fluid communication with the flowpath 62, and will thereby provide fluid communication between the flowpaths 60 and 62. In a similar manner, the opening 58 may be positioned between the seals 70 straddling each one of the other flowpaths 64, 66, 68 to thereby provide fluid communication between that flowpath and the flowpath 60. Thus, by appropriately positioning the sleeve 44 relative to the housing 42, any of the flowpaths 62, 64, 66, 68 may be placed in fluid communication with the flowpath 60.

The sleeve 44 is displaced relative to the housing 42 by pressure differentials between the flowpaths 50, 52 as described above. The ratchet device 46, however, controls the position relative to the housing 42 to which the sleeve 44 is displaced when the pressure differentials are generated in the flowpaths 50, 52. In the embodiment representatively illustrated in FIGS. 2A–C, a certain number of pressure differential reversals between the flowpaths 50, 52 is used to alternately upwardly and downwardly displace the sleeve 44 a desired number of times, so that the sleeve is finally placed in a position in which a desired one of the flowpaths 62, 64, 66, 68 is in fluid communication with the flowpath 60.

The ratchet device 46 is of the type well known to those skilled in the art as a J-slot mechanism. The ratchet device 46 includes a pair of balls 72, a ball retainer 74 and continuous J-slot profiles 76 formed externally on the sleeve 44. The ball retainer 74 secures the balls 72 in 180° opposed positions relative to the housing 42. As the sleeve 44 displaces relative to the housing 42 due to a pressure differential in the flowpaths 50, 52, the balls 72 traverse the J-slot paths 76, thus limiting the extent of the sleeve's displacement in a manner well known to those skilled in the art.

Figure 3:
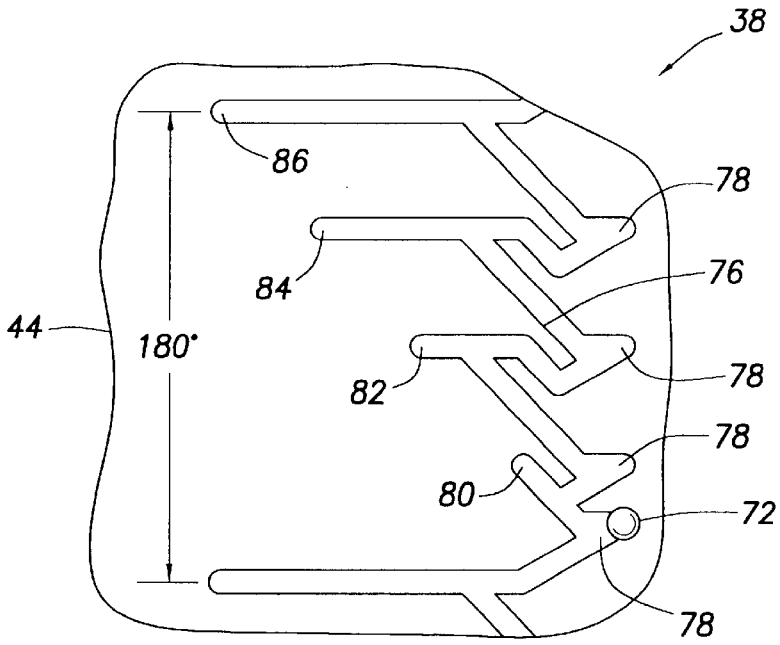
FIG. 3 is a developed view of a J-slot portion of the hydraulic control module.

A portion of the exterior of the sleeve 44 is shown "unrolled" in FIG. 3 and rotated 90°. In this view only one of the paths 76 may be completely seen, but it may also be seen that the paths are interconnected, so that, in effect, the path is duplicated each 180° about the sleeve 44.

One of the balls 72 is also visible in FIG. 3. The ball 72 is positioned in one of four lower portions 78 of the path 76. Note that, when the ball 72 is positioned in one of the lower portions 78, the sleeve 44 is positioned relative to the housing 42 as depicted in FIGS. 2A–C, and none of the flowpaths 62, 64, 66, 68 is in fluid communication with the flowpath 60. This position of the sleeve 44 is obtained by displacing the sleeve 44 upwardly relative to the housing 42 by generating a pressure in the flowpath 50 greater than a pressure in the flowpath 52.

Each of upper portions 80, 82, 84, 86 of the path 76 corresponds to a position of the sleeve 44 relative to the housing 42 in which a respective one of the flowpaths 62, 64, 66, 68 is placed in fluid communication with the flowpath 60. Thus, if the ball 72 is in the portion 80 of the path 76, the flowpath 62 is placed in fluid communication with the flowpath 60. If the ball 72 is in the portion 82 of the path 76, the flowpath 64 is placed in fluid communication with the flowpath 60. If the ball 72 is in the portion 84 of the path 76, the flowpath 66 is placed in fluid communication with the flowpath 60. If the ball 72 is in the portion 86 of the path 76, the flowpath 68 is placed in fluid communication with the flowpath 60.

The ball 72 is received in one of the portions 80, 82, 84, 86 by downwardly displacing the sleeve 44 relative to the housing 42. As described above, the sleeve 44 is downwardly displaced relative to the housing 42 by generating a pressure in the flowpath 52 greater than a pressure in the flowpath 50. The extent to which the sleeve 44 displaces downwardly is limited by the particular portion 80, 82, 84, 86 of the path 76 in which the ball 72 is received when the sleeve displaces downwardly. The particular portion 80, 82, 84, 86 in which the ball 72 is received depends upon which of the lower portions 78 of the path 76 the ball is received in prior to the downward displacement of the sleeve.

The ball 72 circulates about the path 76, and is successively received in alternating ones of the upper portions 80, 82, 84, 86 and lower portions 78 as the pressure differentials between the flowpaths 50, 52 continue to be reversed. Therefore, it will be readily appreciated by one skilled in the art that any one of the flowpaths 62, 64, 66, 68 may be placed in fluid communication with the flowpath 60 by applying a certain number of pressure differential reversals to the flowpaths 50, 52, the last pressure differential downwardly displacing the sleeve 44 so that the ball 72 is received in a respective one of the portions 80, 82, 84, 86. Fluid communication between the flowpath 60 and all of the flowpaths 62, 64, 66, 68 may be prevented by upwardly displacing the sleeve, so that the ball 72 is received in any one of the portions 78 of the path 76.

Figure 5A:
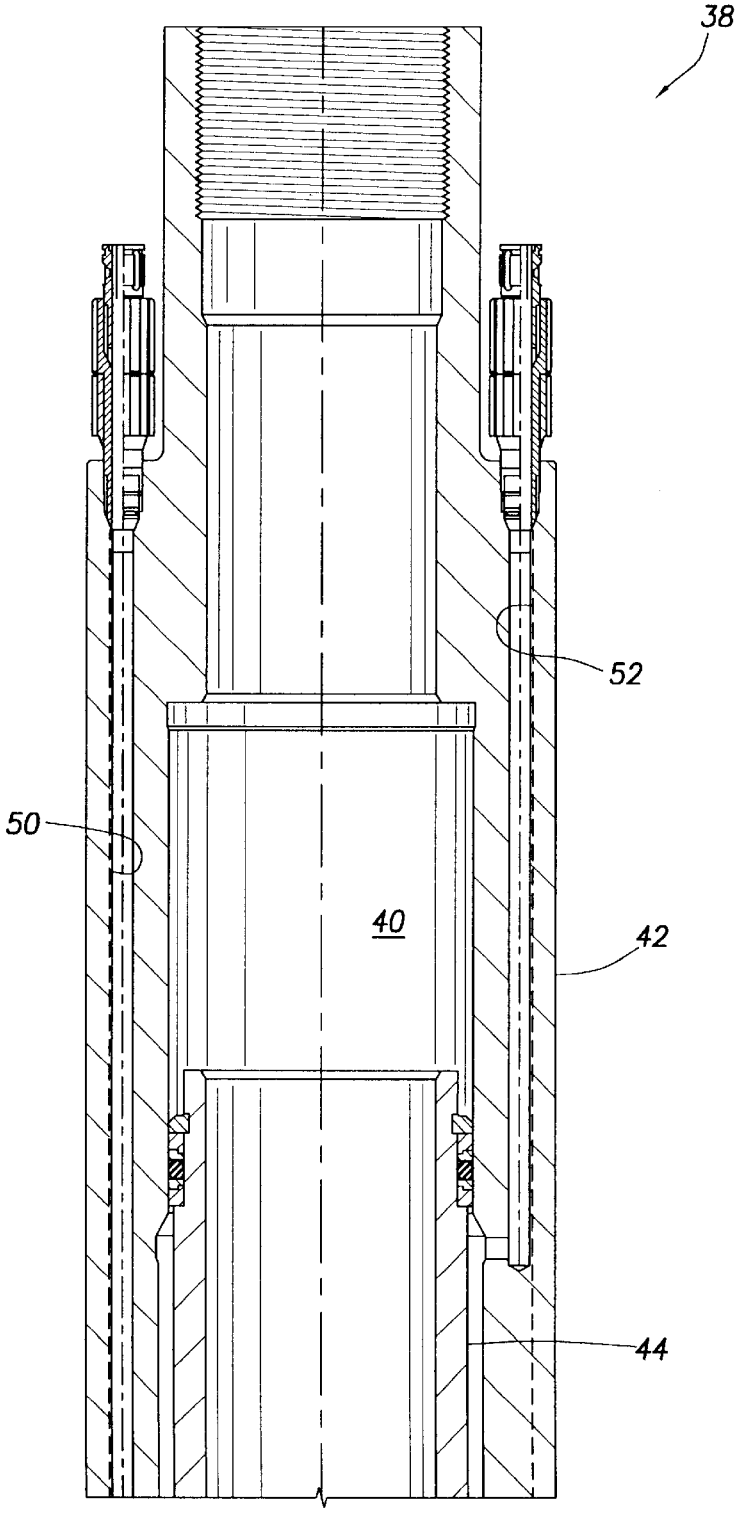
FIGS. 5A–5C are cross-sectional views of successive axial portions of the hydraulic control module in a configuration in which a hydraulic path has been selected for operation of a well tool.
Figure 5B:
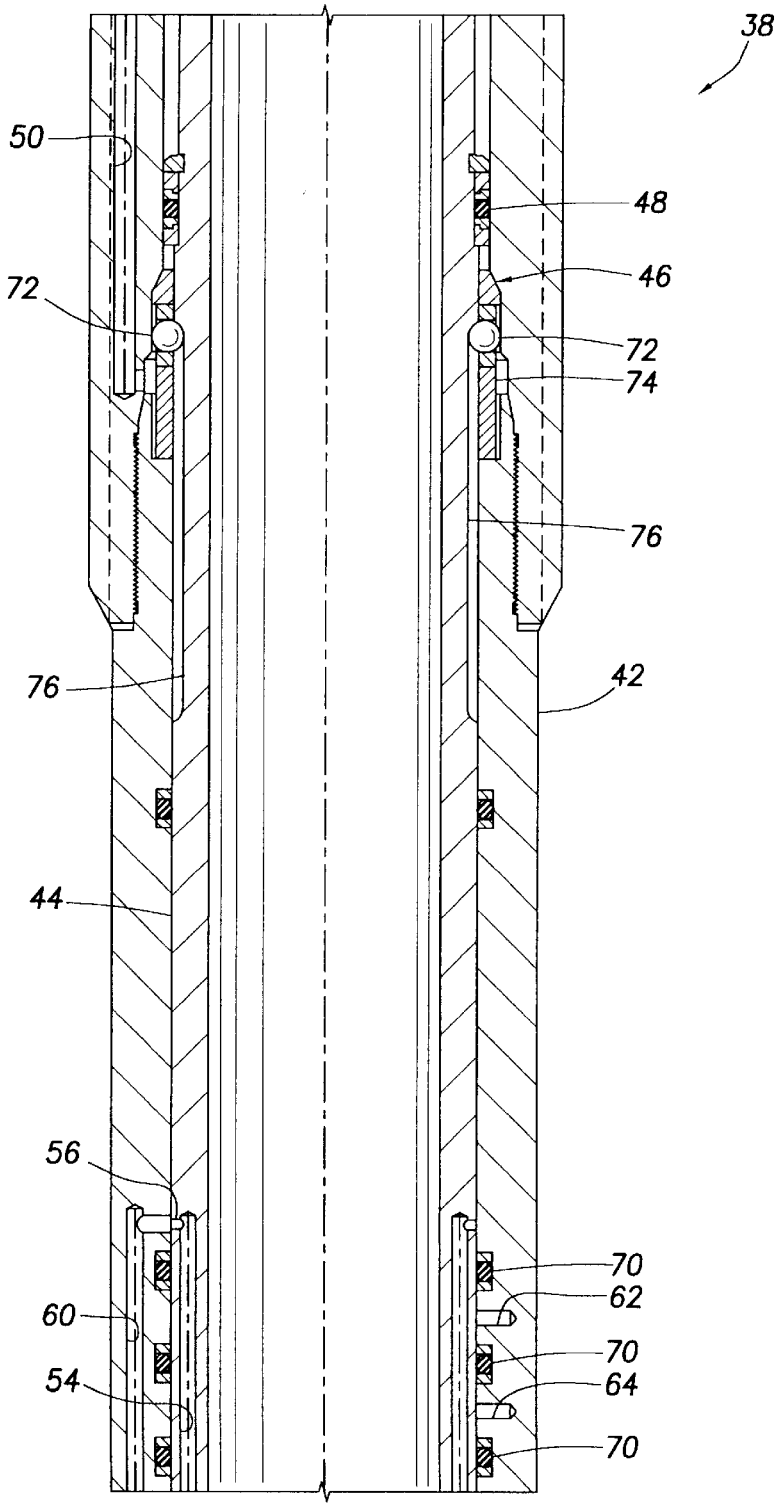
Figure 5C:
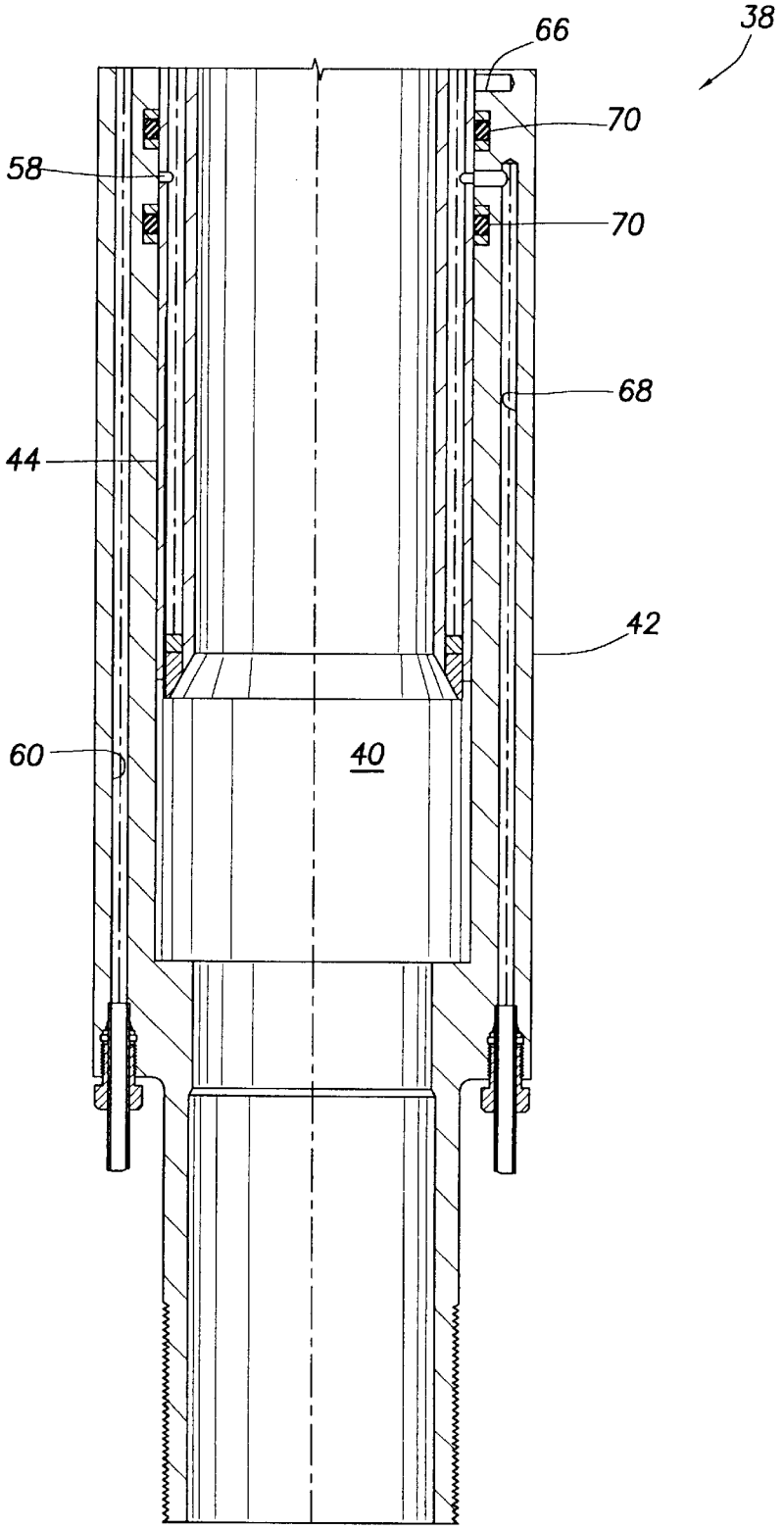
Figure 6:
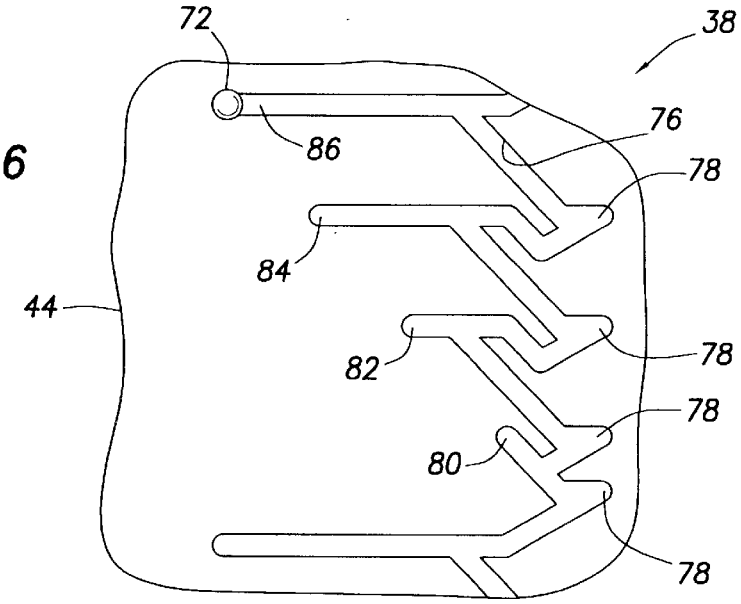
FIG. 6 is a developed view of the J-slot portion of the hydraulic control module in a configuration corresponding to the configuration of the hydraulic control module of FIGS. 5A–C.

Referring additionally now to FIGS. 5A–C, the control module 38 is depicted in a configuration in which the sleeve 44 has been displaced downwardly relative to the housing 42 to a position in which the flowpath 60 has been placed in fluid communication with the flowpath 68. In FIG. 6, it may be seen that the ball 72 is now received in the upper portion 86 of the path 76, corresponding to the selection of the flowpath 68 for fluid communication with the flowpath 60.

Of course, other methods of placing the flowpath 60 in fluid communication with the flowpaths 62, 64, 66, 68 may be utilized, without departing from the principles of the present invention. In addition, more than one of the flowpaths 62, 64, 66, 68 could be simultaneously placed in fluid communication with the flowpath 60, or multiple flowpaths could be placed in fluid communication with respective ones of other multiple flowpaths. More or less numbers of flowpaths could be provided. Other means of positioning the sleeve 44 relative to the housing 42 could be provided. Thus, it is to be clearly understood that the principles of the present invention are not limited to the specific embodiment depicted in FIGS. 2A–C.

If the control module 38 is used for the control module 32 in the method 10, then the flowpaths 50, 52, 60 would be connected to respective ones of the lines 34, and the flowpaths 62, 64, 66, 68 would be connected to respective ones of the lines 36. Manipulation of pressure differentials on the ones of the lines 34 connected to the flowpaths 50, 52 would cause the one of the lines 34 connected to the flowpath 60 to be placed in fluid communication with a particular one of the lines 36 connected to a respective one of the flowpaths 62, 64, 66, 68 to thereby permit operation of a selected one of the well tool assemblies 12, 14, 16, 18 to which that particular one of the lines 36 is connected. Of course, different numbers of well tool assemblies, and different types of well tool assemblies, may be controlled with the control module 38, or a differently configured control module, without departing from the principles of the present invention.

Figure 7:
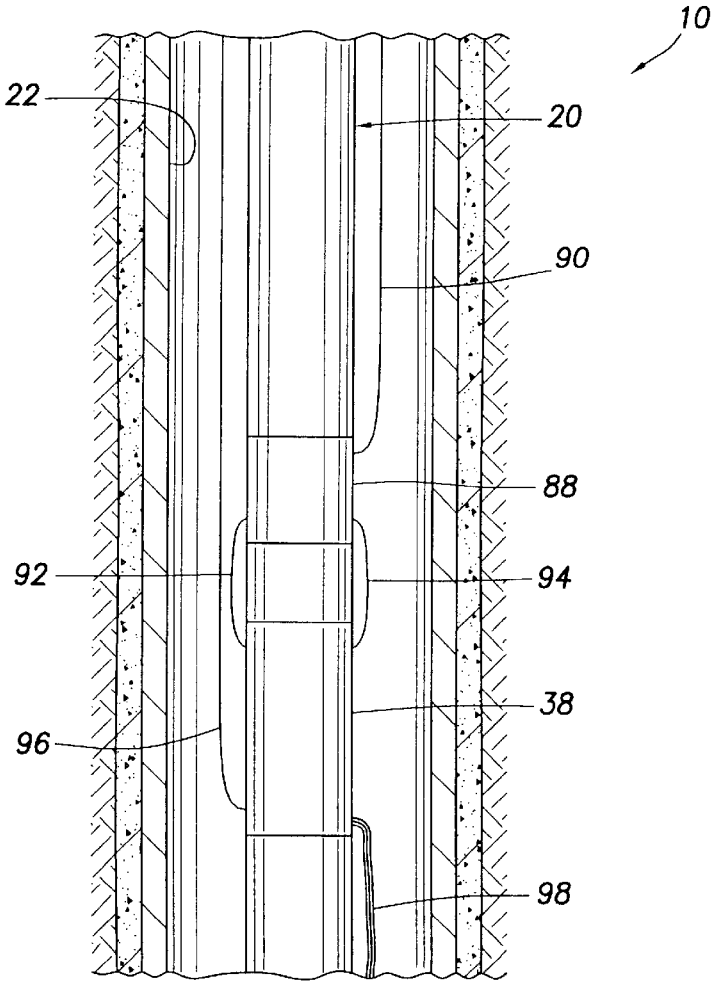
FIG. 7 is a schematic partially cross-sectional view of an alternate configuration of the method of FIG. 1 in which a selector module is utilized in conjunction with the hydraulic control module.

Referring additionally now to FIG. 7, an alternate embodiment of the method 10 embodying principles of the present invention is representatively illustrated. Only a portion of the well schematically shown in FIG. 1 is shown in FIG. 7. Specifically, only a portion of the tubular string 20 in the wellbore 22 is illustrated in FIG. 7.

In the method 10 as depicted in FIG. 7, the control module 38 of FIGS. 2A–C is used for the control module 32 and, in addition, a selector module 88 is interconnected between the control module 38 and one of the lines 34. As depicted in FIG. 7, a line or other flowpath 90 extending to a remote location is connected to the selector module 88 and two lines or other flowpaths 92, 94 extend from the selector module to the control module 38.

The selector module 88 is of the type well known to those skilled in the art which provides fluid communication between an input port and one of multiple output ports. Which one of the multiple output ports is placed in fluid communication with the input port depends upon the pressure at the input port. For the selector module 88, the line 90 is placed in fluid communication with the line 92 when pressure in the line 90 is less than a predetermined pressure, and the line 90 is placed in fluid communication with the line 94 when pressure in the line is greater than a predetermined pressure. A suitable selector module for use as the selector module 88 in the method 10 as depicted in FIG. 7 is the Mini-Hydraulic Module available from Petroleum Engineering Services, Inc. of Spring, Tex., U.S.A.

By varying pressure in the line 90 connected to the selector module 88, fluid communication may be established between the line 90 and a selected one of the lines 92, 94. The other one of the lines 92, 94 is vented to the internal flow passage of the tubular string 20. Thus, with the lines 92, 94 connected to respective ones of the flowpaths 50, 52 of the control module 38, pressure differentials in the flowpaths 50, 52 may be reversed as desired to provide fluid communication between another line or other flowpath 96 connected to the flowpath 60 of the control module and a selected one of lines or other flowpaths 98 connected to respective ones of the flowpaths 62, 64, 66, 68 of the control module.

Figure 8A:
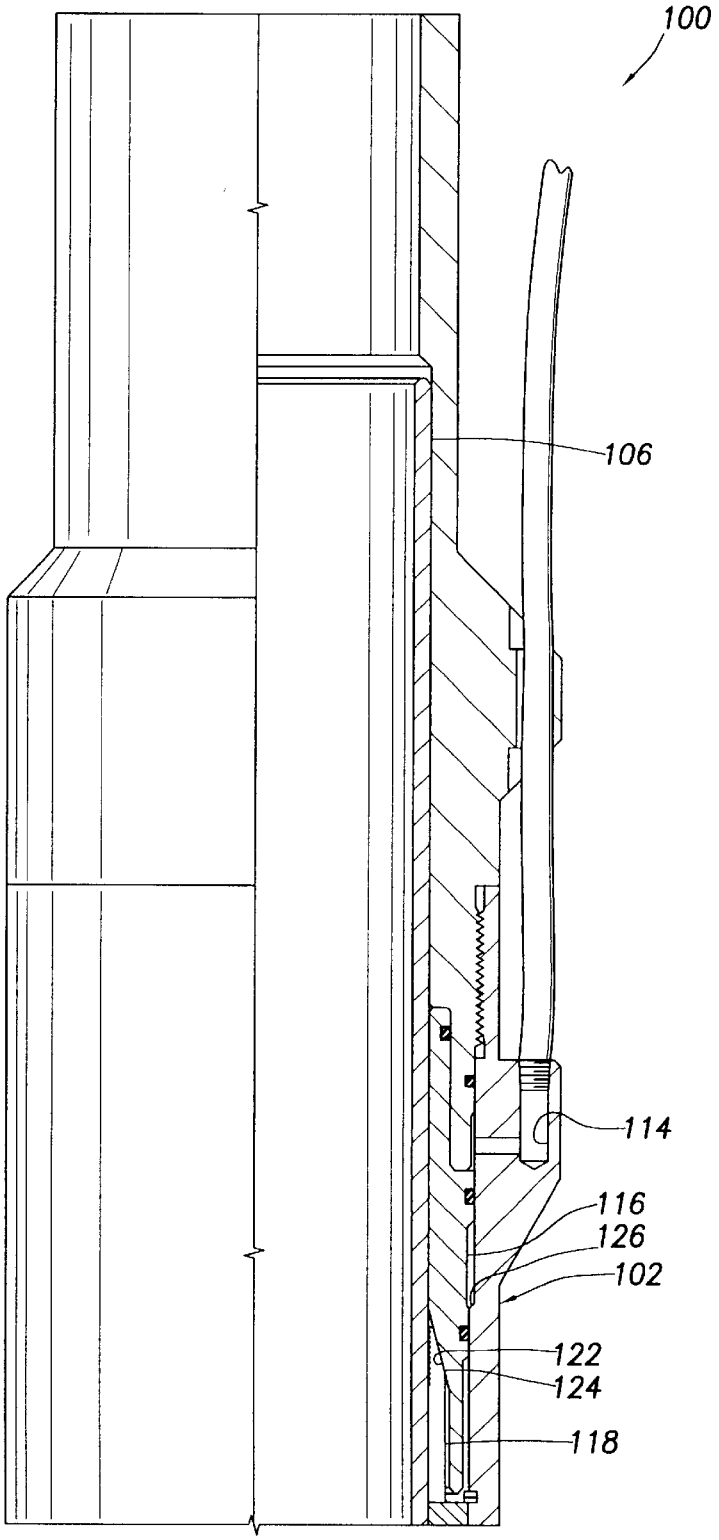
FIGS. 8A–C are cross-sectional views of successive axial portions of a well tool assembly embodying principles of the present invention, which may be utilized in the method of FIG. 1, and the operation of which may be controlled by the hydraulic control module of FIGS. 2A–C.
Figure 8B:
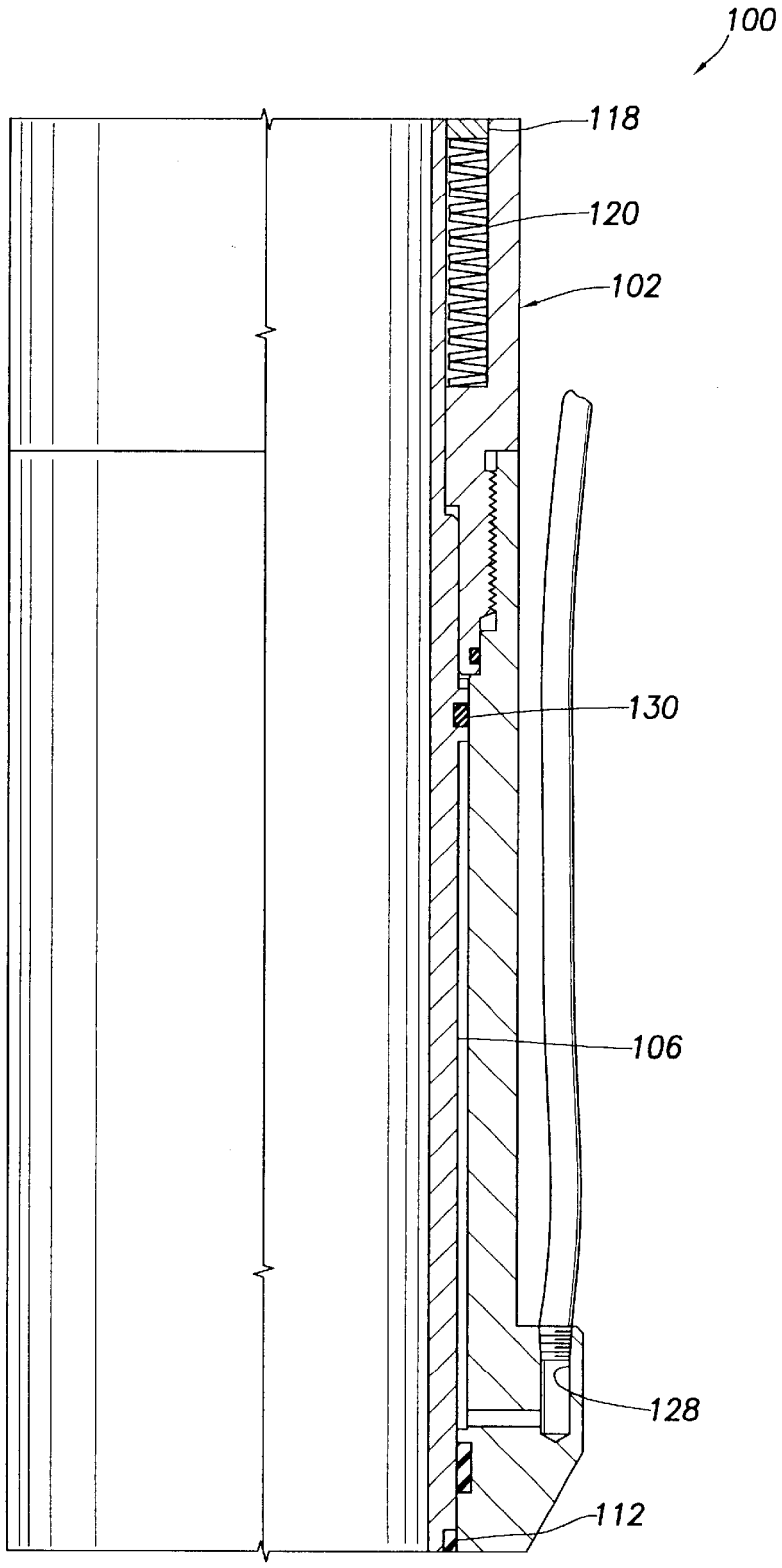
Figure 8C:
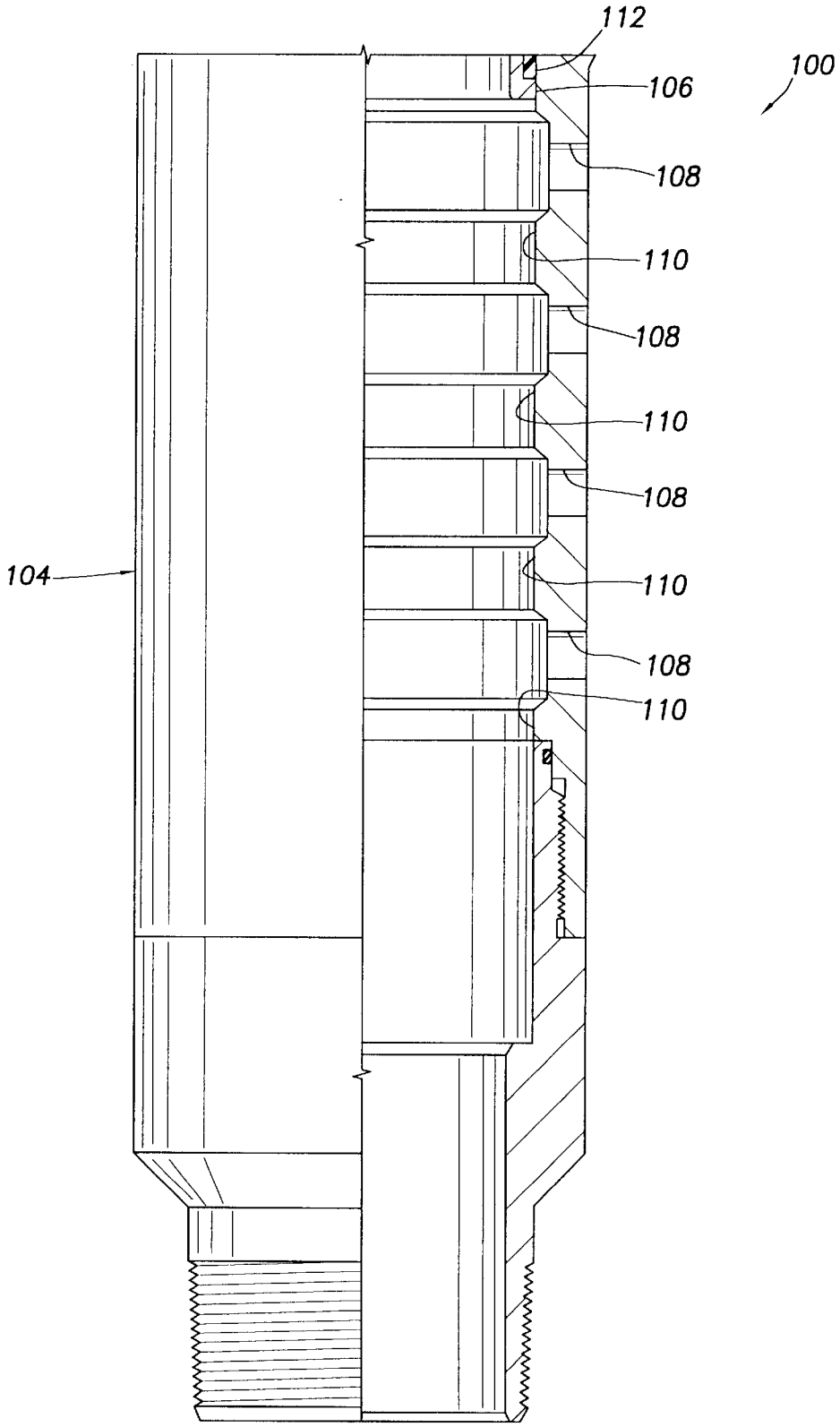

Referring additionally now to FIGS. 8A–C, a well tool assembly 100 embodying principles of the present invention is representatively illustrated. The tool assembly 100 may be utilized for any of the tool assemblies 12, 14, 16, 18 in the method 10. Of course, the tool assembly 100 may also be used in other methods, without departing from the principles of the present invention.

The tool assembly 100 includes an actuator 102, a housing assembly 104 and a closure sleeve 106. In basic terms, the actuator 102 displaces the sleeve 106 relative to the housing 104 to thereby regulate fluid flow through a series of openings 108 formed through a sidewall of the housing. As depicted in FIGS. 8A–C, the sleeve 106 is displaced downwardly relative to the housing 104 to block fluid flow through successive ones of the openings 108 by engaging a seal 112 carried on the sleeve with successive ones of a series of seal surfaces 110 formed internally on the housing 104 between the openings.

The actuator 102 displaces the sleeve 106 downwardly in an incremental fashion in response to an application of pressure to an input port or other flowpath 114. Each application of appropriate pressure to the port 114 produces a corresponding incremental downward displacement of the sleeve 106.

When pressure is applied to the port 114, an annular piston 116 of the actuator 102 is displaced downward into contact with a colletted annular slip member 118. Continued downward displacement of the piston 116 and slip 118 compresses a spring stack or other biasing device 120. Thus, for the slip 118 to be displaced downwardly by the piston 116, the pressure applied to the port 114 must be sufficiently great to cause compression of the spring stack 120.

Contact between cooperatively shaped inclined surfaces 122, 124 formed on the piston 116 and slip 118, respectively, cause the slip to grip the sleeve 106. Thus, when the slip 118 is displaced downwardly by the piston 116, the sleeve 106 is displaced downwardly with the slip. Downward displacement of the piston 116 is limited by an internal shoulder 126 of the actuator 102, and so the downward displacement of the sleeve 106 in response to each application of pressure to the port 114 is limited to the distance which may be traversed by the piston until it contacts the shoulder.

Of course, the sleeve 106 may be displaced incrementally downward a desired total distance by alternately applying pressure to the port 114 and releasing the pressure from the port a sufficient number of times. The spring stack 120 will displace the piston 116 and slip 118 upward when the pressure at the port 114 is relieved, so that they are again in position to displace the sleeve 106 downwardly when the next application of pressure is made to the port 114.

By displacing the sleeve 106 downwardly a desired distance from its position as depicted in FIGS. 8A–C, it will be readily appreciated that a selected number of the openings 108 may be blocked to fluid flow therethrough. In this manner, a flow area through the housing 104 sidewall maybe adjusted as desired, for example to regulate a rate of production from a zone, to regulate a rate of fluid injection into a zone, etc.

After the sleeve 106 has been displaced downwardly as described above, it may be upwardly displaced back to its position as shown in FIGS. 8A–C by applying pressure to another input port 128. Since the slip 118 does not grip the sleeve 106 unless pressure is applied to the port 114, the sleeve is free to displace upwardly when pressure is applied to the other port 128. Pressure at the port 128 causes upward displacement of the sleeve 106 due to a piston area formed on the sleeve below a seal 130 carried on the sleeve. In this manner, the sleeve 106 may be "reset" to its position in which all of the openings 108 are open to flow therethrough, and then, if desired, the sleeve may again be incrementally displaced downwardly by applying a series of pressures to the port 114.

If the tool assembly 100 is used in the method 10 as depicted in FIG. 1, then the port 114 would be connected to one of the lines 36 and the port 128 would be connected to another one of the lines 36. For example, if the control module 38 is used for the control module 32 in the method 10, then one of the flowpaths 62, 64, 66, 68 would be connected to the port 114 and another one of the flowpaths 62, 64, 66, 68 would be connected to the port 128, so that pressure applied to the flowpath 60 could be used to either incrementally displace the sleeve 106 downwardly, or to displace the sleeve upwardly, as desired.

Figure 9:
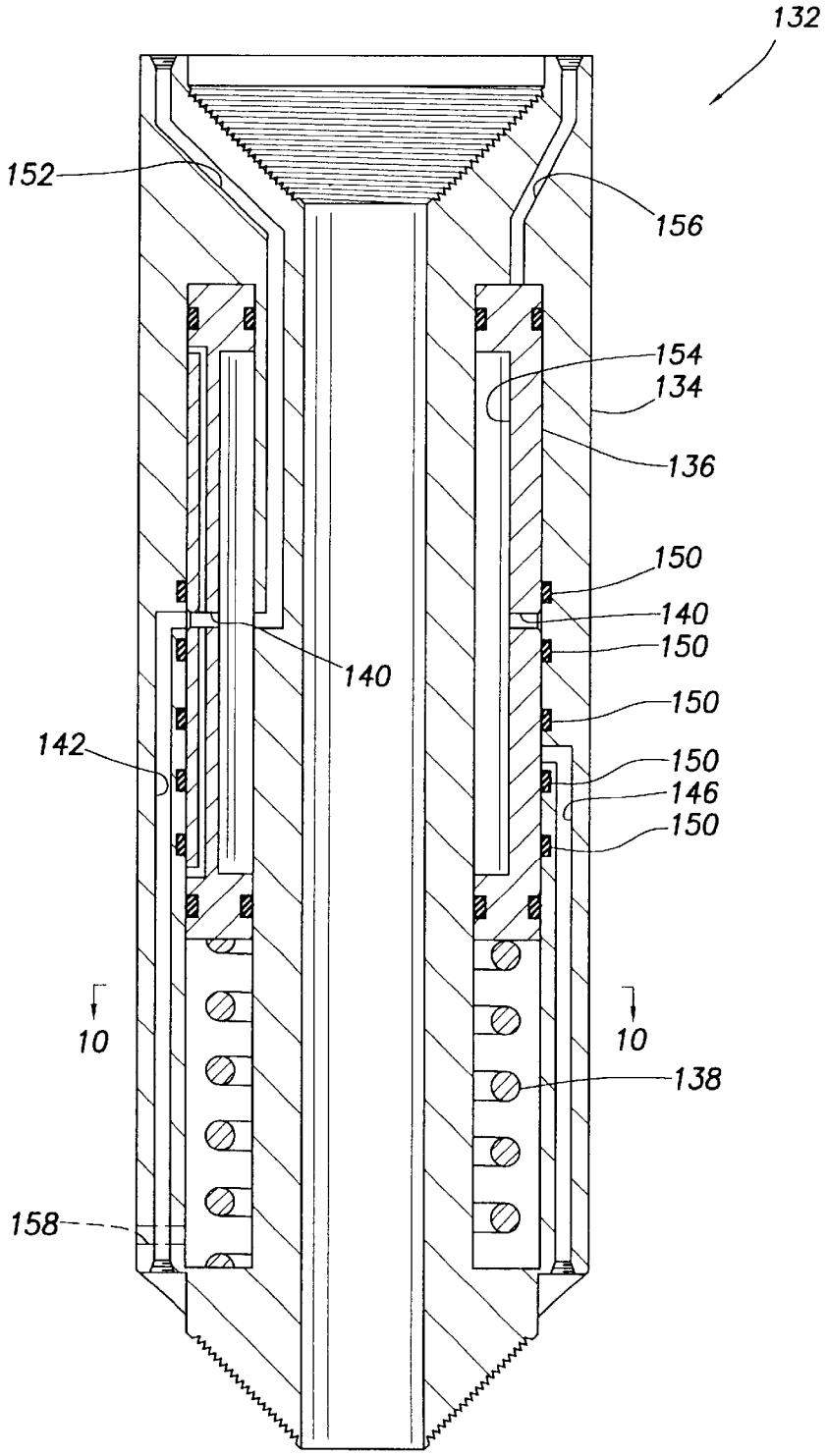
FIG. 9 is a schematic cross-sectional view of another hydraulic control module embodying principles of the present invention, which may be utilized in the method of FIG. 1.

Referring additionally now to FIG. 9, another hydraulic control module 132 embodying principles of the present invention is schematically and representatively illustrated. The control module 132 may be used for the control module 32 in the method 10, or it may be used in other methods, without departing from the principles of the present invention.

The control module 132 includes a housing assembly 134, an annular piston member 136 and a biasing device or spring 138. The piston 136 is displaced downwardly relative to the housing 134 against a biasing force exerted by the spring 138 to thereby place openings 140 formed radially through the piston in fluid communication with a selected one of four flowpaths 142, 144, 146, 148 formed in the housing. Of course, a greater or lesser number of flowpaths may be provided, without departing from the principles of the present invention.

Figure 10:
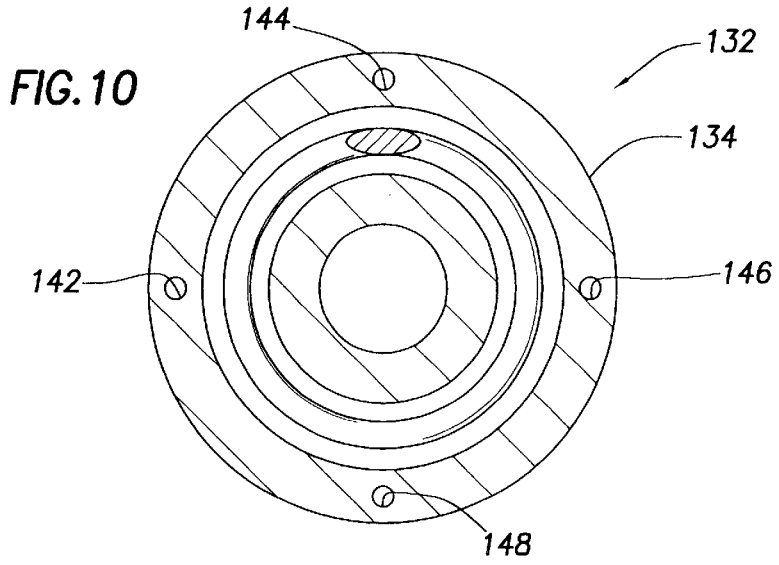
FIG. 10 is a cross-sectional view of the hydraulic control module of FIG. 9, taken along line 10—10 thereof.

Only two of the flowpaths 142, 146 are visible in FIG. 9. However, in FIG. 10 it may be seen that the flowpaths 142, 144, 146, 148 are circumferentially distributed in the housing 134. Each of the flowpaths 142, 144, 146, 148 is in fluid communication with the exterior of the piston 136, but seals 150 straddling each of the flowpaths ensure that only one of the flowpaths may be placed in fluid communication with the openings 140 at a time. Of course, multiple flowpaths could be simultaneously placed in fluid communication with the openings 140, if desired.

As depicted in FIG. 9, with the piston 136 in its uppermost position relative to the housing 134, the openings 140 are in fluid communication with the flowpath 142. In this position of the piston 136, the openings 140 permit fluid communication between the flowpath 142 and another flowpath 152 formed in the housing 134. The flowpath 152 is in fluid communication with the openings 140 via a recess 154 internally formed on the piston 136.

The flowpath 152 remains in fluid communication with the opening 140 via the recess 154 when the piston 136 is displaced downwardly relative to the housing 134. Thus, each of the flowpaths 142, 144, 146, 148 may be selectively placed in fluid communication with the flowpath 152 by displacing the piston 136 to a particular position relative to the housing 134.

The piston 136 is displaced downwardly relative to the housing 134 by applying pressure to another flowpath 156 formed in the housing. Pressure in the flowpath 156 biases the piston 136 downward against the upwardly biasing force of the spring 138 and an upwardly biasing force on the piston due to pressure external to the housing 134, communicated to the piston via an opening 158 formed through a sidewall of the housing. As is well known to those skilled in the art, the biasing force exerted by the spring 138 will increase as the piston 136 is displaced downwardly. Therefore, by applying a certain pressure to the flowpath 156, a known downward displacement of the piston 136 may be achieved, corresponding to a known upwardly biasing force exerted by the spring 138 and by the known pressure external to the housing 134.

It is to be clearly understood that other types of biasing devices may be used in the control module 132 in place of the spring 138. For example, a compressed fluid, such as Nitrogen, could be used to exert an upwardly biasing force on the piston 136. Thus, the principles of the present invention are not limited to the specific embodiment of the control module 132 described herein.

If the control module 132 is used for the control module 32 in the method 10, one of the lines 34 would be connected to the flowpath 152 and another one of the lines 34 would be connected to the flowpath 156. The flowpaths 142, 144, 146, 148 would be connected to respective ones of the lines 36. In this manner, a predetermined pressure applied to one of the lines 34 connected to the flowpath 156 would cause the other one of the lines 34 connected to the flowpath 152 to be placed in fluid communication with a selected one of the lines 36 connected to a corresponding one of the flowpaths 142, 144, 146, 148 for operation of one of the well tools 12, 14, 16, 18 connected thereto.

Figure 11:
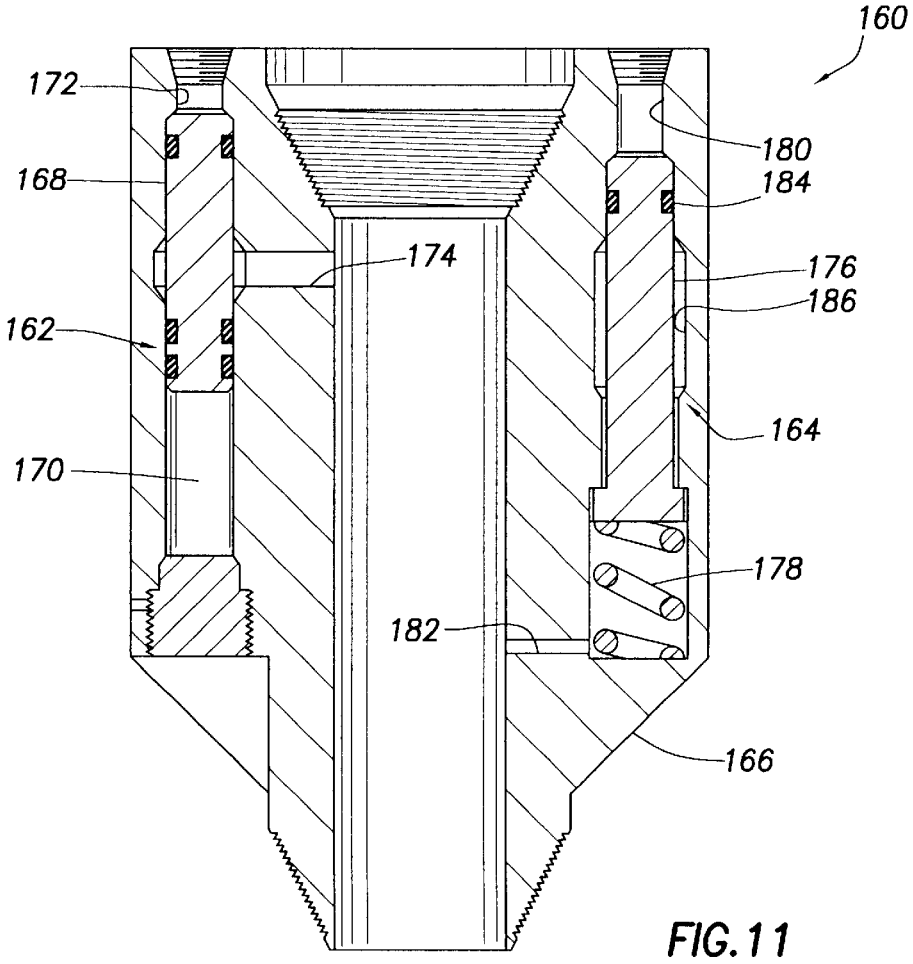
FIG. 11 is a schematic cross-sectional view of another well tool assembly embodying principles of the present invention, which may be utilized in the method of FIG. 1, and the operation of which may be controlled by the hydraulic control module of FIG. 9.

Referring additionally now to FIG. 11, a well tool assembly 160 embodying principles of the present invention is schematically and representatively illustrated. The tool assembly 160 is of a type the operation of which may be controlled utilizing either of the control modules 38, 132 described herein. Specifically, the tool assembly 160 includes a housing assembly 166 containing a hydraulically actuated temperature sensor 162 and a hydraulically actuated pressure sensor 164.

The temperature sensor 162 includes a piston 168 and a chamber 170. The chamber 170 contains a gas, such as Nitrogen, or another fluid which responds rheologically to changes in temperature. The fluid in the chamber 170 is exposed to the temperature in a well when the tool assembly 160 is interconnected in a tubular string, such as the tubular string 20 in the method 10, or is otherwise positioned in the well.

When the fluid is introduced into the chamber 170 before the tool assembly 160 is positioned in the well, the temperature, pressure and volume of the fluid are known. When the fluid is subsequently exposed to the temperature in the well, its pressure will typically increase, due to the typically higher temperatures experienced in downhole environments. This change in pressure due to change in temperature for a given fluid is also known. In addition, if the volume of the fluid is changed while the fluid is exposed to the well temperature, it is also known that a certain change in pressure of the fluid will result.

The temperature sensor 162 further includes flowpaths 172 and 174 formed in the housing 166. The piston 168 initially prevents fluid communication between the flowpaths 172, 174. However, after the tool assembly 160 is positioned in the well and the fluid in the chamber 170 has been exposed to the well temperature, pressure is applied to the flowpath 172 and the pressure is gradually increased. Eventually, the downwardly biasing force due to the pressure in the flowpath 172 will overcome the upwardly biasing force due to the pressure of the fluid in the chamber 170 and the piston 168 will displace downward a sufficient distance, so that fluid communication is permitted between the flowpaths 172, 174.

As depicted in FIG. 11, the flowpath 174 is in fluid communication with the interior of the housing 166. When the piston 168 is displaced downwardly and permits fluid communication between the flowpaths 172, 174, the pressure in the flowpath 172 will suddenly decrease, due to the pressure in the flowpath 172 being vented to the interior of the housing 166. This sudden decrease in the pressure in the flowpath 172 gives an indication that the piston 168 has displaced downward to a known position (that position which permits fluid communication between the flowpaths 172, 174) at which point the volume of the chamber 170 is also known.

Therefore, the pressure in the flowpath 172 which results in the piston 168 being displaced to produce a known volume of the chamber will correspond to a particular temperature of the fluid in the chamber 170. By recording the maximum pressure in the flowpath 172 which may be achieved, and which causes the piston 168 to permit fluid communication between the flowpaths 172, 174, a person skilled in the art may readily determine the corresponding temperature of the fluid in the chamber 170.

As depicted in FIG. 11, areas of the piston 168 exposed to pressure in the flowpath 172 and in the chamber 170 are approximately equal, and the piston is balanced with respect to pressure in the flowpath 174. However, it will be readily appreciated that that the areas of the piston 168 exposed to each of the flowpaths 172, 174 and the chamber 170 may be varied as desired to produce different relationships between pressures in the flowpaths and chamber when fluid communication is permitted between the flowpaths.

The pressure sensor 164 includes a piston 176 and a biasing device or spring 178. In its position as depicted in FIG. 11, the piston 176 prevents fluid communication between two flowpaths 180, 182 formed in the housing 166. The spring 178 biases the piston 176 upward toward the position depicted in FIG. 11.

Pressure applied to the flowpath 180 will bias the piston 176 downward against the upwardly biasing force exerted by the spring 178. Pressure in the flowpath 182 also biases the piston 176 upward. As illustrated in FIG. 11, the flowpath 182 is in fluid communication with the interior of the housing 166, but it could alternatively be in fluid communication with the exterior of the housing, or it could be in fluid communication with any other region, the pressure of which is to be measured using the pressure sensor 164.

The pressure in the flowpath 180 is gradually increased, and eventually the downwardly biasing force on the piston 176 resulting therefrom overcomes the upwardly biasing forces due to the spring 178 and the pressure in the flowpath 182. At this point the piston 176 begins to displace downwardly. Further increase in the pressure in the flowpath 180 will cause a seal 184 carried on the piston 176 to enter a recess 186 internally formed on the housing 166, thereby permitting fluid communication between the flowpaths 180, 182.

The point at which fluid communication between the flowpaths 180, 182 is permitted will be indicated by a drop in the pressure in the flowpath 180, if the pressure in the flowpath 182 is less than the pressure in the flowpath 180, thereby venting the pressure in the flowpath 180. The spring rate of the spring 178, the initial compression (preload) of the spring and the additional compression of the spring 178 needed to permit the piston 176 to displace downwardly a sufficient distance for the seal 184 to enter the recess 186 are known. Therefore, the maximum pressure achieved in the flowpath 180 to cause the piston 176 to permit fluid communication between the flowpaths 180, 182 corresponds to a certain pressure in the flowpath 182. By recording the maximum pressure achieved in the flowpath 180, a person skilled in the art may readily determine the pressure of the pressure source in communication with the flowpath 182.

As an example of a use of the tool assembly 160, it may be interconnected to the control module 132 and positioned in a well in the method 10. In that case, one of the lines 34 would be connected to the flowpath 152, another one of the lines 34 would be connected to the flowpath 156, one of the lines 36 would be connected between the flowpath 142 and the flowpath 172, and another of the lines 36 would be connected between the flowpath 144 and the flowpath 180. If it were desired to sense the temperature of the well proximate the tool assembly 160, pressure in the flowpath 156 would be adjusted as needed to place the flowpath 152 in fluid communication with the flowpath 142, and then pressure in the flowpath 152, and thus the flowpaths 142 and 172, would be gradually increased until fluid communication is permitted between the flowpaths 172, 174. This pressure corresponds to a certain temperature of the fluid in the chamber 170. If it were desired to sense the pressure in the well (for example, the pressure in the interior of the tubular string 20, with the pressure sensor 164 configured as depicted in FIG. 11), pressure in the flowpath 156 would be adjusted as needed to place the flowpath 152 in fluid communication with the flowpath 144, and then pressure in the flowpath 152, and thus in the flowpaths 144 and 180, would be gradually increased until fluid communication is permitted between the flowpaths 180, 182. This pressure corresponds to a certain pressure in the flowpath 182.

Note that these operations of sensing temperature and sensing pressure utilizing the tool assembly 160 may be repeated as often as desired by merely applying pressure to either of the flowpaths 172, 180, and recording the pressure at which fluid communication is permitted between the flowpaths 172, 174 or between the flowpaths 180, 182.

Although the temperature sensor 162 and pressure sensor 164 have been depicted in FIG. 11 as being combined in the tool 160 configured for interconnection in a tubular string, it is to be clearly understood that the sensors may be separately utilized, and that the sensors may each be used as components in other hydraulic circuits. For example, the sensors 162, 164 may be used as hydraulic circuit components in a manner similar to that in which other components, such as check valves, etc., are utilized in various hydraulic circuits.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A hydraulic control system for controlling operation of multiple well tool assemblies interconnected thereto, the system comprising:

a control module interconnected between at least one first flowpath extending to a remote location and second flowpaths extending to the well tool assemblies for operation thereof, the control module including a member having a fluid passage, the member being selectively displaceable to predetermined positions, in each of the predetermined positions the fluid passage permitting fluid communication between the first flowpath and at least one of the second flowpaths; and a tubular string positioned in a wellbore, the control module being interconnected in the tubular string, whereby an internal flow passage extending through the control module member is a portion of an internal flow passage of the tubular string.

2. The system according to claim 1, wherein the fluid passage is at least partially internally formed in the member.

3. The system according to claim 1, wherein the control module further includes a ratchet device, the ratchet device responding to pressure in at least one third flowpath connected to the control module.

4. The system according to claim 3, wherein the ratchet device displaces the member to the predetermined positions in response to a series of pressure applications to the third flowpath.

5. The system according to claim 4, wherein the ratchet device is a J-slot mechanism operative to displace the member relative to the second flowpaths.

6. The system according to claim 1, wherein the member further has a position thereof in which the first flowpath is isolated from fluid communication with any of the second flowpaths.

7. The system according to claim 1, wherein the member is displaced in response to a pressure differential between at least first and second ones of third flowpaths connected to the control module.

8. The system according to claim 7, further comprising a selector module interconnected between the third flowpaths and a fourth flowpath, the selector module permitting fluid communication between the fourth flowpath and the first one of the third flowpaths when pressure in the fourth flowpath is less than a predetermined pressure, and the selector module permitting fluid communication between the fourth flowpath and the second one of the third flowpaths when pressure in the fourth flowpath is greater than the predetermined pressure.

9. The system according to claim 1, wherein the first flowpath is placed in fluid communication with at least one of the second flowpaths when the member is displaced to one of the predetermined positions against a force exerted by a biasing device.

10. The system according to claim 9, wherein fluid pressure in a third flowpath connected to the control module displaces the member against the biasing device force.

11. The system according to claim 10, wherein a first predetermined fluid pressure in the third flowpath displaces the member to a corresponding first selected one of the predetermined positions and a second predetermined fluid pressure in the third flowpath displaces the member to a corresponding second selected one of the predetermined positions.

12. A method of controlling operation of multiple well tool assemblies positioned in a well, the method comprising the steps of:

interconnecting a control module to each of the well tool assemblies, the control module including a member displaceable to multiple predetermined positions, each of the predetermined positions corresponding to one of the well tool assemblies for operation thereof;

interconnecting the control module in a tubular string, thereby making an internal flow passage extending through the control module member a portion of an internal flow passage of the tubular string; and displacing the control module member to a selected first one of the predetermined positions utilizing pressure in a first flowpath connected to the control module, thereby selecting a first one of the well tool assemblies for operation thereof.

13. The method according to claim 12, further comprising the step of providing fluid communication between a second flowpath connected to the control module and an actuator of the first selected well tool assembly in response to the displacing step.

14. The method according to claim 13, wherein the fluid communication providing step further comprises providing the fluid communication through a fluid passage of the control module member.

15. The method according to claim 14, further comprising the step of displacing the control module member to a second selected one of the predetermined positions, thereby providing fluid communication through the fluid passage between the second flowpath and an actuator of a second one of the well tool assemblies for operation thereof.

16. The method according to claim 12, wherein the displacing step further comprises displacing the control module member against a force exerted by a biasing device, the force increasing in response to displacement of the control module member.

17. The method according to claim 16, wherein the displacing step further comprises utilizing a first predetermined pressure in the first flowpath to displace the control module member a first predetermined distance to the first predetermined position against a first predetermined force exerted by the biasing device.

18. The method according to claim 17, further comprising the step of displacing the control module member against a second predetermined force exerted by the biasing device to a second one of the predetermined positions utilizing a second predetermined pressure in the first flowpath, thereby selecting a second one of the well tool assemblies for operation thereof.

19. The method according to claim 12, wherein the displacing step further comprises utilizing a ratchet mechanism to control displacement of the control module member in response to pressure in the first flowpath.

20. The method according to claim 12, wherein the displacing step further comprises displacing the control module member in response to a differential between pressure in the first flowpath and pressure in a second flowpath connected to the control module.

21. The method according to claim 20, further comprising the steps of:

interconnecting a selector module between a third flowpath and the first and second flowpaths;

generating a first pressure in the third flowpath less than a predetermined pressure, thereby causing the selector module to permit fluid communication between the third flowpath and one of the first and second flowpaths; and generating a second pressure in the third flowpath greater than the predetermined pressure, thereby causing the selector module to permit fluid communication between the third flowpath and the other of the first and second flowpaths.

* * * * *